US005893241A

United States Patent [19]

Schroeder

[11] Patent Number: 5,893,241

[45] Date of Patent: Apr. 13, 1999

[54] PRECAST CONCRETE TARGET HOUSE

[76] Inventor: Michael P. Schroeder, 1916 Westbreeze Dr., Oshkosh, Wis. 54904

[21] Appl. No.: 09/003,699

[22] Filed: Jan. 5, 1998

[51] Int. Cl.[6] ..... E04H 9/04

[52] U.S. Cl. ..... 52/79.1; 52/124.2; 52/125.5; 52/169.6

[58] Field of Search ..... 52/79.1, 169.6, 52/124.2, 125.5

[56] References Cited

U.S. PATENT DOCUMENTS

| | | | |
|---|---|---|---|
| 3,074,080 | 1/1963 | Previti | 52/169.6 |
| 3,356,183 | 12/1967 | Shell | 52/169.6 X |
| 3,822,569 | 7/1974 | Lautrup-Larsen | 52/79.1 X |
| 3,990,197 | 11/1976 | Johnston | 52/79.1 X |
| 5,035,077 | 7/1991 | Palmer | 52/79.1 X |
| 5,210,985 | 5/1993 | Hsu | 52/169.6 |

*Primary Examiner*—Christopher Kent
*Attorney, Agent, or Firm*—R. Jonathan Peters

[57] ABSTRACT

A precast, concrete building unit which is especially adaptable as a target house formed from concrete pour comprising a horizontal floor adaptable for placement on a subgrade, and vertical walls extending upright from the perimeter of the floor and precast integrally therewith. One or more inserts is imbedded in the concrete pour in the marginal walls of at least two of the opposed, vertical walls, and is adaptable for accepting a removable fastening element for releasable engagement with the embedded insert to facilitate lifting and handling. At least one recess is formed in the marginal walls of at least two opposed vertical walls. A roof is precast as a separate unit from concrete pour, and is provided with a downwardly depending fastening element for registry with the recesses as the roof is positioned over the walls so as to join or attach the roof with the walls to form an integral building unit. The roof is provided with transverse holes for registry with each of the inserts, and to accommodate the removable fastening element extendable through the hole and into engagement with the insert. An opening is provided in one of the walls to allow for access to the interior of the building unit.

12 Claims, 5 Drawing Sheets

PRECAST CONCRETE TARGET HOUSE

FIELD OF THE INVENTION

This invention relates to a precast, concrete target house. In its more specific aspect, this invention relates to a precast, concrete target house for transport to the site of use as an integral unit for placement on a subgrade.

BACKGROUND AND PRIOR ART

Precast concrete structures offer economy, flexibility, and reliability, and today are commonplace. For example, precast concrete applications include wall panels, floor slabs, pilings, columns, tunnel liners, and other structural and architectural components. The advantage with precast structures and components is that the units are produced in plant under close quality control that affect durability and strength. The precast item can be transported to the site and installed with a minimum of labor.

Precast, concrete building components as integrated sub-units are shown in the prior art. For example, U.S. Pat. No. 4,606,878 shows a precast, concrete building unit with three integrated walls, and the fourth wall is later added to enclose the structure. Also, precast, concrete components of a building or housing are disclosed in U.S. Pat. No. 5,560,150 and in German Patent 2322920. It is important, however, that as many of the individual components as possible be precast as an integral unit. This criterion is especially true for a structure that rests directly on or is partially embedded in the ground, such as a target house for target shooting.

Target houses, such as a trap house, are made of cast masonry blocks, or more typically of separate precast, concrete components, namely, a floor slab, wall panels, and roof Each of the concrete components is poured separately at the site. That is, in constructing such a house, which is partially embedded or submerged in the ground and the components poured one at a time, first the floorslab is poured below the ground surface, the walls are then poured upright from the floor and extend above the ground surface, and lastly the roof is poured into the walls. Each component is poured on separate days, and it takes a minimum of three days to complete one unit. The joints between the slabs and panels are caulked, but this caulking is usually temporary. Not only must such structures be durable, but these structures must be resistant to deterioration from weather extremes. Further, the building unit must resist moisture penetration, and fungus, and must be pest and rot resistant. Caulking, weather stripping, flashing, and the like, do not provide a permanent or lasting protection. The problems and attempts to solve them are aggravated with a target house that is partially embedded or submerged in the ground.

This invention has, therefore, as its purpose to provide a precast, concrete target house that has the advantages of factory control, and the advantages of delivery of an integrated building unit to the site which can be installed promptly and with minimum labor.

It is another object of the invention to provide a precast, concrete target house that has no below ground surface joints that are susceptible to deterioration, separation, and damage.

It is yet another object of the invention to provide a precast, concrete target house that includes a precast pedestal, to serve as a mount for the firing machine, formed integrally with the building unit or house.

It is still another object of the invention to provide a precast, concrete target house that overcomes the disadvantages of the prior art houses.

SUMMARY OF THE INVENTION

In accordance with the present invention, there is provided a precast, concrete building unit which is especially adaptable as a target house (e.g., trap house) for target shooting, and is formed from concrete pour. The building unit comprises a substantially horizontal floor adaptable for placement on a subgrade or the ground, and substantially vertical walls (i.e., two opposed end walls, and two opposed side walls) extending upright from the perimeter of the floor and formed or precast integrally therewith, that is, as an integral sub-unit, from poured concrete. In the manufacture of this precast, integral sub-unit, concrete comprising cement, aggregate, a curing or hardening agent, and water, is poured into a mold and allowed to set or harden. At least one insert, such as a threaded insert or coil loop insert that is internally threaded, is imbedded in the concrete pour in the marginal walls of at least two of the opposed, vertical walls. Each insert opens to the marginal wall, and is adaptable for accepting a removable fastening element, such as a coil bolt or threaded bolt, for releasable engagement with the embedded insert to facilitate handling the precast sub-unit when removing it from the mold, after it has cured or hardened, and when handling and loading the complete building unit and transporting it to the site for installation, as described hereinbelow in greater detail. At least one recess or hole is formed in the marginal walls of at least two opposed vertical walls, and preferably the recesses are preformed in the concrete pour.

A roof is precast as a separate unit from concrete pour, and is provided with downwardly depending fastening means, such as a star pin, anchor bolt, or the like, for registry with the recesses. The fastening means are adaptable for insertion into the recesses of the walls as the roof is positioned over the walls so as to join or attach the roof with the walls. Also, the roof is provided with transverse holes (i.e., transverse relative to the horizontal plane of the root) for registry with each of the inserts, and the holes are of sufficient size (i.e., diameter and length) to accommodate the removable fastening element extendable through the hole and into engagement with the insert. Preferably, the recesses are filled with a bonding agent, such as grout, mortar, or the like, and the roof set in place so that the bonding agent cures or hardens around the fastening means thereby securing the roof to the walls so as to form an integral building unit. An opening is provided in one of the walls to allow for access to the interior of the building unit.

In a preferred embodiment of my invention, the undersurface or interior surface of the roof lies in a substantially horizontal plane, and the top surface of the roof is sloped relative to the horizontal plane of the undersurface, thereby forming a precast, sloped roof with a surface that provides adequate run-off or drainage. In yet another modification of the invention, I have found it preferable to provide the roof with a sufficient overhang having in the undersurface a drip groove or drip edge.

Further, it is preferable that the opening in the wall to allow access to the interior of the building unit is precast when forming the integral sub-unit of floor and walls. The opening formed is bounded along the top for a substantial portion of the top perimeter of the wall and downwardly from the perimeter to form a substantially rectangular cutaway. Also, it is preferable that the marginal surfaces of the opening are pitched outwardly (that is, the outside edge dimensions of the opening are slightly greater than the inside edge dimensions), thereby facilitating removal of the precast unit from the mold. Because of the opening or cutaway in one of the vertical walls, it is preferable to provide for the inserts and recesses in the two opposed side walls normal to the wall with the opening.

In yet another modification of the invention, a pedestal is precast from concrete pour so as to be adjoined to the floor and/or wall of the building unit. The pedestal is positioned adjacent or in abutment with the wall having the opening and at a height suitable for supporting a firing machine mounted on the pedestal.

BRIEF DESCRIPTION OF THE DRAWINGS

The invention and its advantages will be more readily understood by reference to the following detailed description and exemplary embodiment when read in conjunction with the following drawings, wherein.

DETAILED DESCRIPTION OF THE INVENTION

Figure 2:
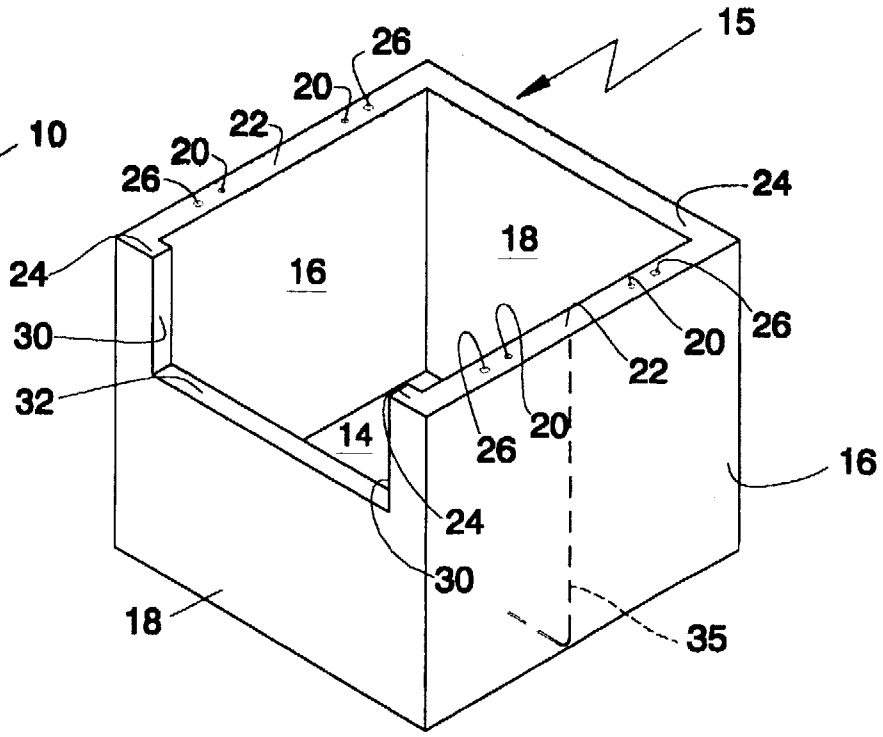
FIG. 2 is a perspective view of a precast sub-unit comprising the floor and four vertical walls.
Figure 1:
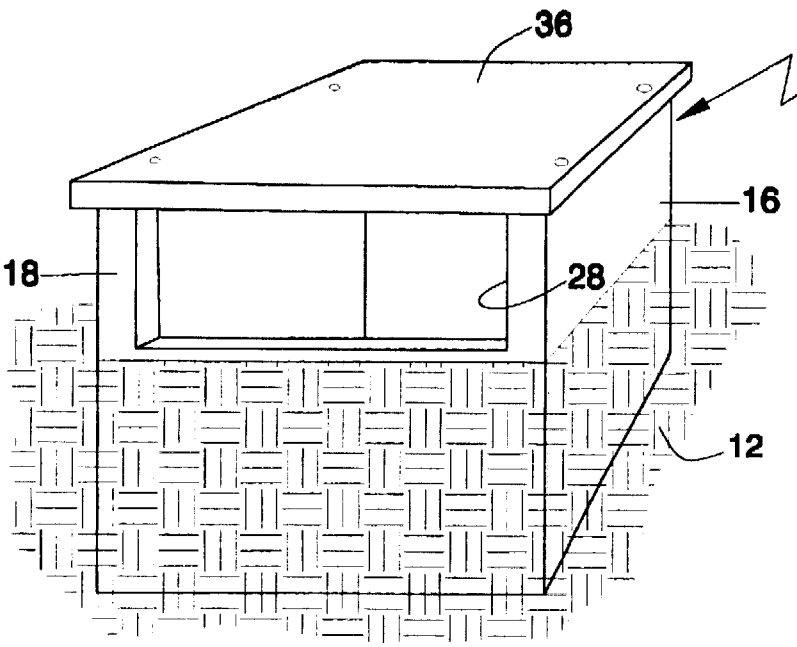
FIG. 1 is a perspective view of a precast, concrete target house formed in accordance with the invention, and embedded partially in the ground.
Figure 4:
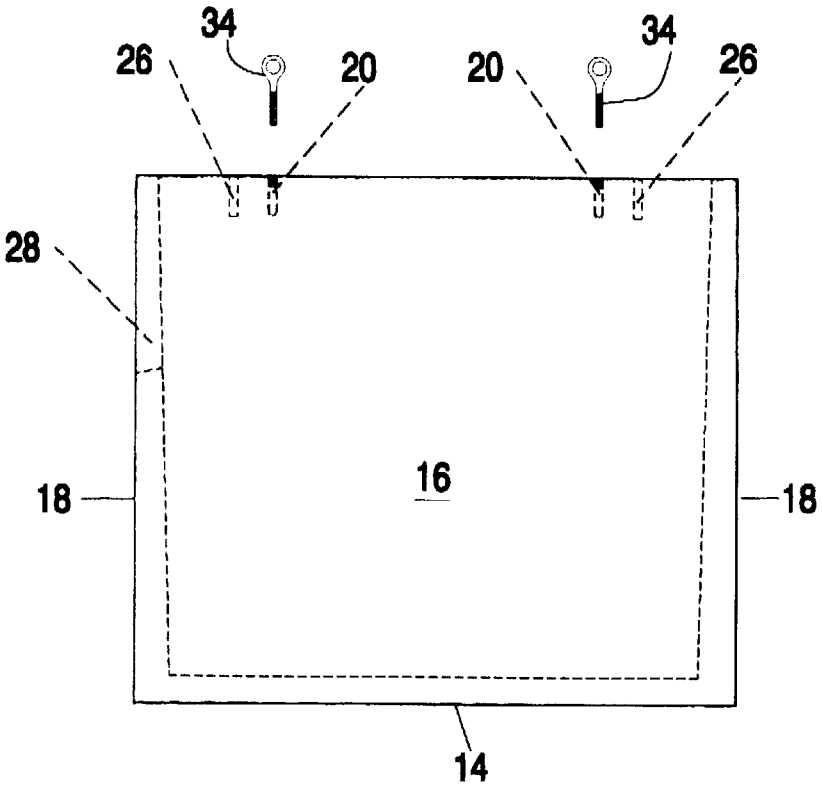
FIG. 4 is a side elevational view of the precast sub-unit of FIG. 2.
Figure 3:
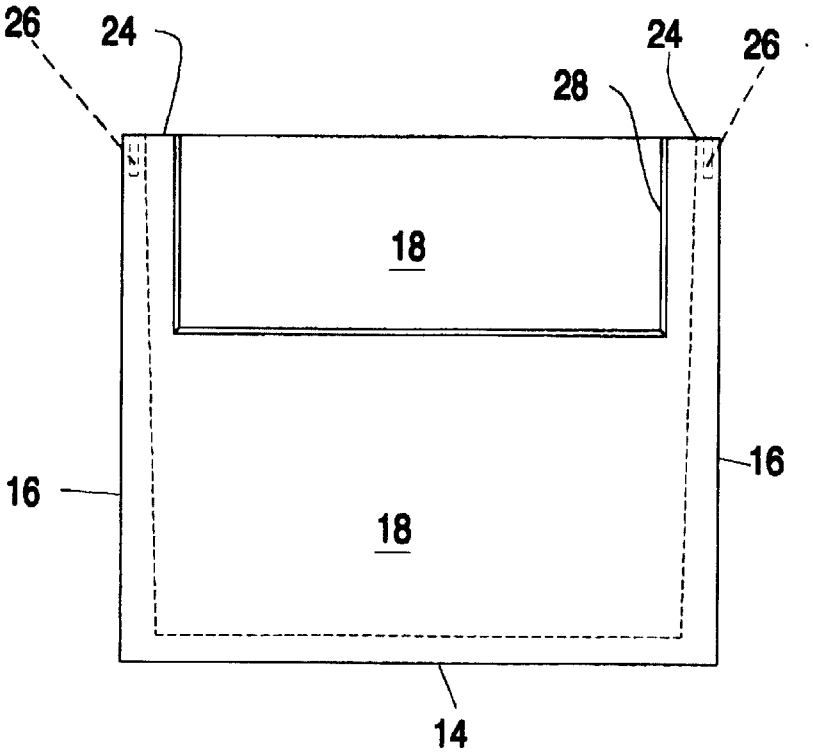
FIG. 3 is a front elevational view of the precast sub-unit of FIG. 2.
Figure 5:
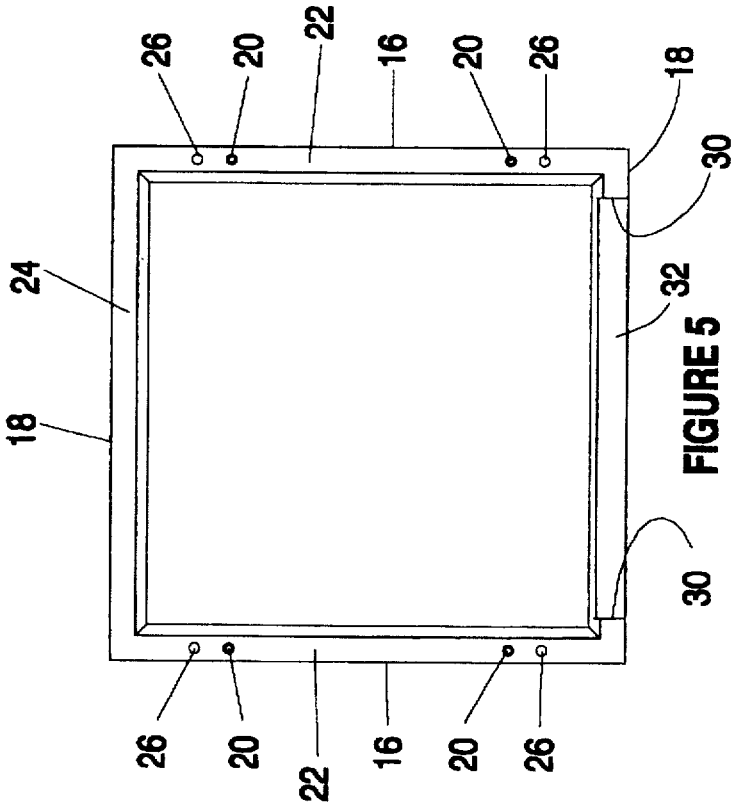
FIG. 5 is a plan view of the precast sub-unit of FIG. 2.

In referring to the drawings, wherein like reference numerals refer to similar parts throughout the various views, there is illustrated in FIG. 1 a precast, concrete trap house, indicated generally by the numeral 10, as set in the ground 12. It should be understood that although reference is made specifically to a trap house, and although the precise structure may vary depending upon the type of target shooting, such as trap shooting versus skeet shooting, the invention is applicable in general to a target house. The concrete building unit comprises a precast floor 14, and opposed side walls 16 and opposed end walls 18 extending upright from the perimeter of the floor, as best shown in FIG. 2. It will be observed that the floor and four vertical walls are shaped as a continuous form in a suitable mold from poured concrete, and when hardened or cured, the form is removed from the mold as an integral sub-unit, indicated by the numeral 15, as illustrated in FIG. 2. It is preferable that the interior surface of the walls are pitched or tapered relative to the vertical plane as viewed in elevation (see FIGS. 3 and 4) in order to facilitate removal of the precast sub-unit from the mold.

When forming the precast, integral unit described above, one or more inserts 20, and preferably two spaced apart inserts, are embedded in the longitudinal marginal walls 22 of the two opposed side walls 16. Suitable inserts are standard items and are commercially available, and may include, for example, a coil loop insert, an internally threaded insert, or the like. The inserts open to the marginal wall surfaces 22 for the reason described below in detail. Where desired, inserts may be provided in the marginal walls 24 of the two opposed end walls 18 in addition to those set in the side walls, but I have found that this is generally unnecessary. In addition, the marginal wall surfaces 22 of vertical side walls 16 are provided with one or more recesses 26, and preferably two spaced apart recesses, utilized in attaching the roof to the walls as explained below in detail. It will be observed that the inserts 20 and recesses 26 are embedded or preformed, so that when the sub-unit is cured, these members are formed in place.

One end wall 18 is provided with a precast opening 28 to allow access to the interior of the building unit. Where desired, the integral sub-unit as shown in FIG. 2 can first be formed, and the opening then cut in one of the end walls, but I have found it more expedient to precast the unit with the opening preformed. Preferably, the boundary for opening 28 in end wall 18 is defined by spaced, marginal side walls 30, which are substantially parallel, extending downwardly from the top perimeter of the end wall and interconnected by horizontal wall or sill 32 to form a substantially rectangular cutaway, having no top or upper marginal wall, as shown in FIG. 2. The opening 28 should have sufficient dimensions for allowing ingress and egress by an operator to and from the trap house and for allowing a machine for firing clay pigeons to be placed in the house. For example, the outside dimensions specified by the Amateur Trapshooting Association for a trap house are in the range of about six feet eight inches high and seven feet eight inches square, which is adequate for housing the machine and operator. These dimensions allow for an adequate opening, and when the target house is placed in the ground, the bottom wall 32 of the opening 28 is just above the surface of the ground. Preferably, the marginal walls of the opening are tapered outwardly to facilitate removal from the mold.

The precast, integral sub-unit of floor and vertical walls is formed in a steel mold from concrete pour. The concrete may comprise Portland cement, a relatively fine aggregate such as sand, a water reducer such as Daracem 19 from Grace Construction Products, and water, but the formulation or recipe can vary depending upon such factors as availability of materials, and the environment of the location for the target house. After molding, the sub-unit is allowed to cure, and then removed from the mold. In order to lift the sub-unit from the mold, a removable fastening element 34, such as a coil bolt or threaded bolt and are commercially available items, is engaged with the insert 20. The head or exposed end of the fastening element 34 is attached to a lifting crane, or other suitable lifting means, (not shown) and the precast sub-unit is then lifted from the mold. Where desired, the vertical walls may be provided with a plurality of longitudinally disposed reinforcing rods 35, which are spaced apart and parallel, and embedded in the concrete pour. The rods may be angled at the bottom so as to extend into the floor. Only one such rod is shown in FIG. 2 in order to avoid unnecessary clutter or confusion.

A roof 36 is precast as a roof panel in a suitable mold or form from concrete pour having a formulation the same or about the same as the concrete pour for the sub-unit described above. The precast roof is positioned atop the sub-unit and attached to the horizontal marginal surfaces of the vertical walls. In order to accomplish this, a fastening means 38, such as a star pin, anchor bolt, or the like, is embedded in the concrete pour, and the shank portion or pin 40 of the fastening means protrudes beyond the undersurface of the roof and aligns with the recess 26, which is dimensioned to accommodate the downwardly depending portion of the fastening means. The recesses are filled with a bonding agent such as mortar, and preferably the downwardly depending portion is configured as with barbs, threads, fins, etc., so as to complement the holding power of the bonding agent. Thus, when the roof is positioned atop the sub-unit, the downwardly depending portion of the fastening means aligns with the recess and extends into the recess so that the roof lays flush with the top marginal surfaces of the vertical walls. When the bonding agent has set or hardened, the roof is then permanently attached to the sub-unit. It is desirable to caulk the joints between the roof and vertical walls.

In addition, the roof 36 is provided with transverse holes 42 for registry with the inserts 20. Thus, when the roof is positioned onto the sub-unit, the transverse holes 42 align with the inserts 20. A removable fastening element 34 is inserted through the hole and into engagement with the insert. Suitable fastening elements include, for example, shoulder eye bolt having coil threads with a forged head. The fastening element has an exposed end that protrudes beyond the upper surface of the roof so that the jaw of a crane (not shown) can grasp the fastening element and lift the complete building unit onto a truck for transport to the installation site.

Figure 6A:
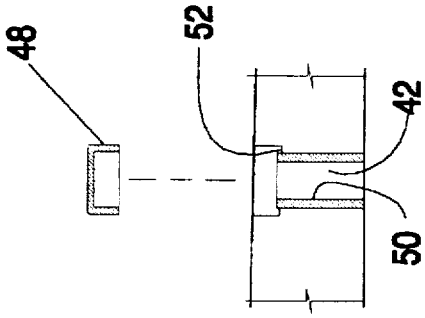
FIG. 6A is a cross-sectional view taken on line 6A—6A of FIG. 6, with certain dimensions exaggerated for purposes of clarity.
Figure 6:
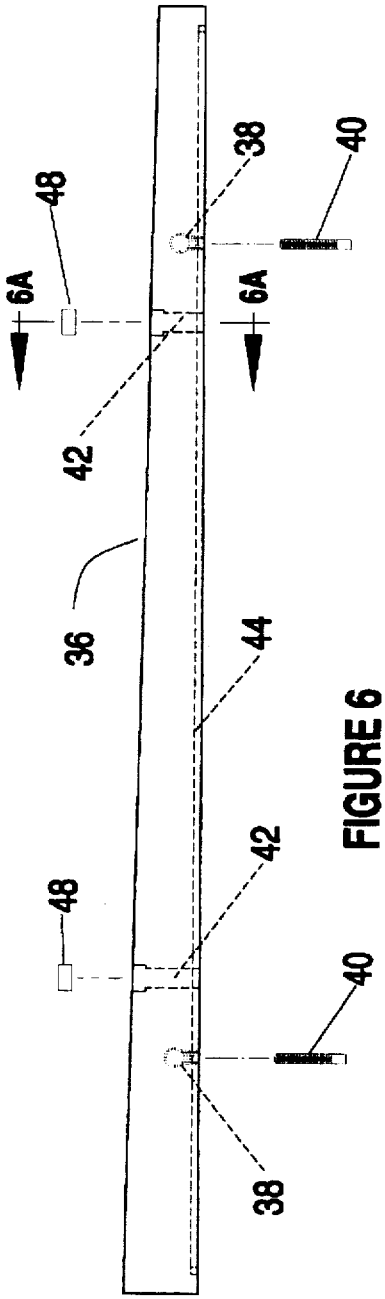
FIG. 6 is a side elevational view of the roof of the precast house of FIG. 1.

With a conventional target house, drainage or run-off is achieved by simply providing a sloped roof. That is, the side walls are sloped or inclined so that the front is higher than the back, and the roof assumes this sloped position. A square or level setting of the roof onto the vertical walls, however, is better for a tighter fit at the joints, and provides more interior room. My invention achieves this feature by providing the roof 36 with a substantially horizontal, planar undersurface and a top surface that is sloped relative to the horizontal plane of the undersurface, as illustrated in FIG. 6. In this manner, the roof sits level relative to the walls and floor, but has an upper surface that is sloped or inclined so as to provide for run-off of water.

Figure 8:
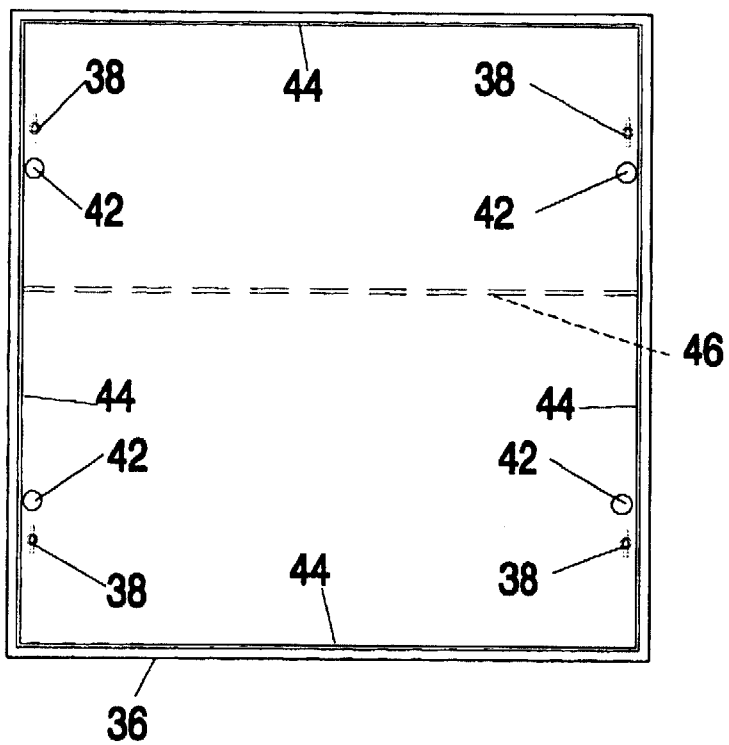
FIG. 8 is a plan view of the roof of FIG. 6 as viewed from the undersurface.
Figure 7:
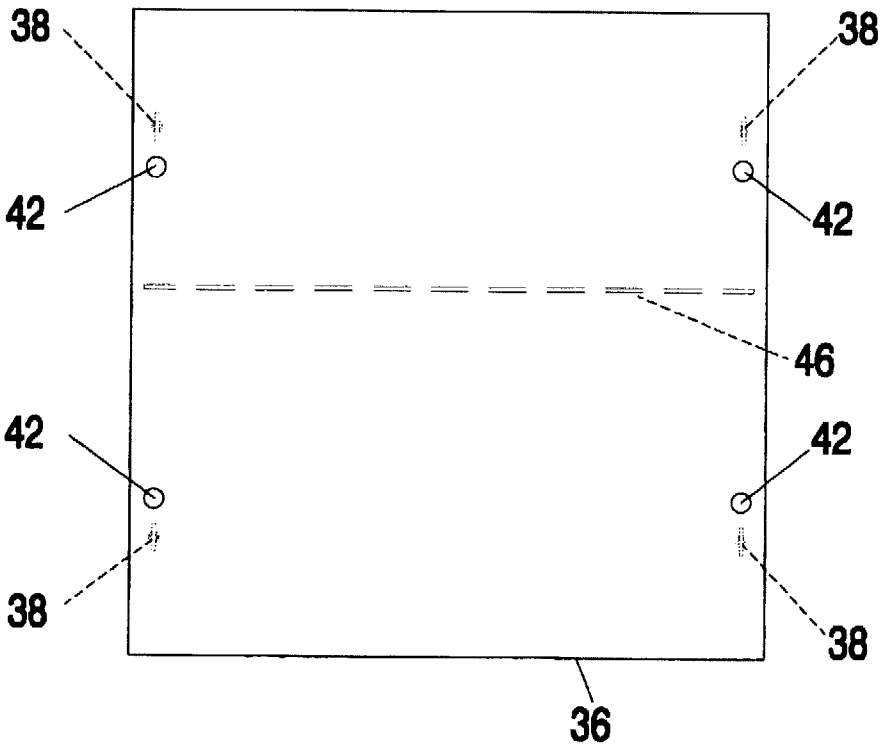
FIG. 7 is a plan view of the roof of FIG. 6 as viewed from the top.
Figure 10:
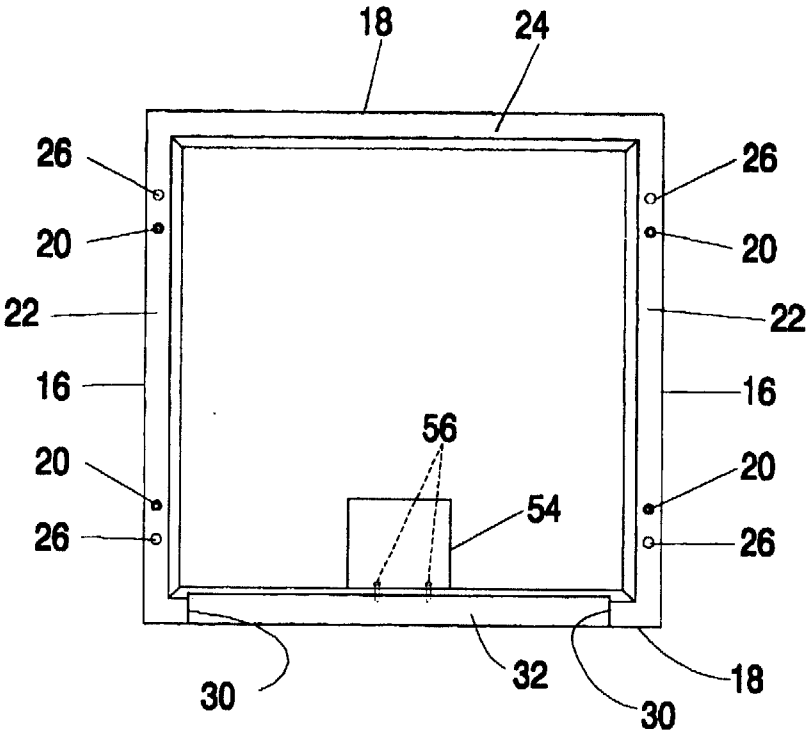
FIGS. 9 and 10 are views similar to FIGS. 3 and 5, respectively, but showing a pedestal adjoined to the side wall and floor of the building unit.
Figure 9:
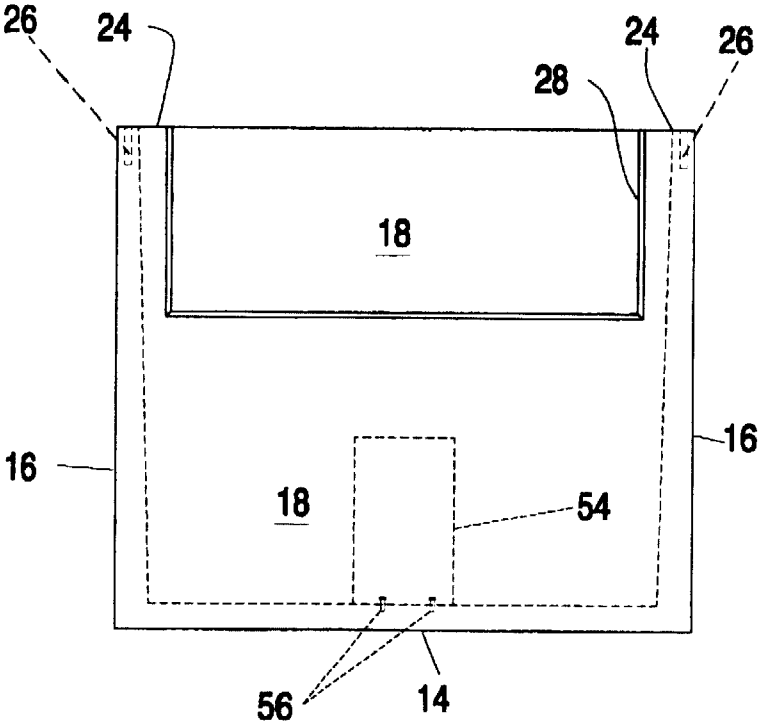

It is beneficial to minimize or eliminate any contact of water run-off with the joints between the roof and vertical walls. I accomplish this by providing a roof with an overhang, as illustrated in FIG. 1. Even with an overhang, however, water draining from the top surface of the roof, flows down the vertical edge of the overhang, and wets the undersurface of the overhang and flows into contact with the joint. In order to essentially eliminate this flow path, and to protect the joint from water run-off, I provide the undersurface of the overhang with longitudinal grooves 44 extending nearly the complete length and width thereof so as to intersect at the corners. The grooves 44 serve as a drip edge, so that water flowing down the overhang contacts the drip edge and falls to the ground, thereby substantially eliminating contact of water with the joints.

Where desired, the roof may be provided with a plurality of longitudinally disposed reinforcing rods 46, which are spaced apart and parallel. Only one such rod is shown in FIGS. 7 and 8 in order to avoid unnecessary clutter and confusion.

It will be observed that by reason of my invention, the complete building can be loaded on a truck, transported to the building site, and installed. However, when the target house is in place, the transverse holes 42 in the roof 36 must be plugged or capped. For this purpose, there is provided a closure means or cap 48. It is important that the closure be water tight, and the hole 42 is provided with a tubular insert 50 having a diameter less than the diameter of the cap and a length less than the thickness of the roof The upper portion of the hole has a second or enlarged diameter, thereby forming annular shoulder 52, to accommodate the cap. Upon insertion of the cap into the hole, the cap abuts shoulder 52, and the top of the cap is about flush with the top surface of the roof, thereby providing an essentially water-tight fit.

In a further modification of the invention, the building unit is provided with a precast concrete pedestal 54 formed as an integral part of the sub-unit 15. Accordingly, after the unit 15 is precast and set, a suitable mold is positioned on the floor 14, and preferably the mold is three-sided so as to abut the wall 18. Also, one or more holes are drilled in the floor and wall, preferably two holes in each, and an anchoring bolts 56 or other fastening means is set in each hole so as to protrude beyond the floor or wall surface (upward from the floor or outward from the wall), and concrete is poured into the mold. When the concrete has hardened, the mold is removed, and anchoring means 56 retains the pedestal in position and attached to the sub-unit 15 at the floor or at the floor and wall. The top surface of the pedestal is typically below the sill 32, usually at least about six to eight inches. A machine for propelling the clay pigeon can then be placed on the pedestal.

It will be observed that by reason of my invention, the precast, concrete target house provides several advantages, including in-factory control, durability and resistance to environmental conditions and moisture penetration. Further, it should be understood that the foregoing detailed description has been given for clearness of understanding only, and no unnecessary limitations should be understood therefrom, as modifications will be obvious to those skilled in the art.

What is claimed is:

1. A precast, concrete target house formed from concrete pour, comprising:

(a) a substantially horizontal floor adapted for placement on a subgrade, and opposed end walls and opposed side walls extending upright from the perimeter of said floor, said side walls having horizontal marginal surfaces, said floor and walls precast as an integral unit from concrete pour;

(b) at least one insert embedded in the concrete pour at the horizontal marginal surfaces of each of said side walls and adaptable for accepting a removable fastening element;

(c) at least one recess in the horizontal marginal surfaces of each of said side walls and spaced from said insert, (d) a roof having (i) downwardly depending fastening means for registry with said at least one recess to join said roof with said end walls and said side walls to form an integral building unit, and (ii) transverse holes for registry with each of said inserts, said removable fastening element adaptable for extending through each of said transverse holes for engagement with each of said inserts to facilitate handling of said building unit; and (e) an opening in one of said end walls to allow for access to the interior of said building unit.

2. A precast, concrete target house according to claim 1 wherein said roof has a substantially horizontal, planar undersurface and a top surface that is sloped relative to the horizontal plane of said undersurface.

3. A precast, concrete target house according to claim 1 or claim 2 wherein said opening is precast in one of said end walls.

4. A precast, concrete target house according to claim 3 wherein said end wall having a top perimeter, and said opening extends downwardly from said top perimeter to form a substantially rectangular cutaway.

5. A precast, concrete target house according to any one of claims 1, 2, or 4 wherein said insert is a threaded insert, and said removable fastening element is threaded for threadable engagement with said threaded insert.

6. A precast, concrete target house according to any one of claims 1, 2, or 4 wherein the marginal edges of said opening are pitched outwardly.

7. A precast, concrete target house according to claim 6 wherein said roof is provided with an overhang, and the undersurface of said overhang is provided with a drip edge.

8. A precast, concrete target house according to claim 7 wherein said end walls and said side walls are tapered relative to the vertical plane as viewed in elevation.

9. A precast, concrete target house according to any one of claims 1, 2, 4, 7 or 8 further including means for capping said transverse holes.

10. A precast, concrete target house according to claim 9 further including a plurality of longitudinally extending reinforcing rods embedded in said end walls, side walls, and roof.

11. A precast, concrete target house according to claim 10 wherein each of said transverse holes has a first diameter terminating with an annular shoulder and a second larger diameter extending upwardly from said shoulder, and said means for capping comprises a substantially cylindrical cap having a closed top and depending side wall terminating with an annular marginal edge for seating on said shoulder.

12. A precast, concrete target house according to any one of claims 1, 2, 4, 7, 8, 10 or 11 further including a precast concrete pedestal disposed on said floor and adjacent said opening.

* * * * *